United States Patent [19]

Ferrara

[11] 4,194,635

[45] Mar. 25, 1980

[54] X-RAY FILM GRIP

[75] Inventor: Peter T. Ferrara, Valley Cottage, N.Y.

[73] Assignee: AGFA-Gevaert, Antwerp, Belgium

[21] Appl. No.: 853,311

[22] Filed: Nov. 21, 1977

[51] Int. Cl.[2] ..... A47F 7/16; B42F 1/00

[52] U.S. Cl. ..... 211/45; 24/67.3; 211/89

[58] Field of Search ..... 24/67.3, 67.11, 67.9; 211/45, 89, 124; 248/452

[56] References Cited

U.S. PATENT DOCUMENTS

| | | | |
|---|---|---|---|
| 2,209,953 | 8/1940 | Youngquist | 211/89 |
| 2,760,288 | 8/1956 | Shoenfeld | 211/45 |
| 3,168,954 | 2/1965 | Herrmann | 211/89 |

FOREIGN PATENT DOCUMENTS

| | | | |
|---|---|---|---|
| 190701 | 8/1956 | Fed. Rep. of Germany | 24/67.3 |
| 1191942 | 4/1965 | Fed. Rep. of Germany | 24/67.11 |
| 992983 | 10/1944 | France | 24/67.3 |

*Primary Examiner*—Kenneth Dorner
*Attorney, Agent, or Firm*—Lee C. Robinson, Jr.

[57] ABSTRACT

An X-ray film grip or sheet support member, adapted to cooperate with a sheet support surface such as the lighted face of an X-ray film viewer, includes an elongated hollow framed element having a longitudinally extending slot formed therein facing the sheet support surface. An elongated spring element is mounted in the frame and has a plurality of separate spring fingers formed thereon, each of which has a bent central portion positioned adjacent to and normally projecting from the slot towards the sheet support surface, so that when an X-ray film sheet is positioned between the frame and the support surface the sheet will be engaged by the bent portions of the spring fingers and held against the support surface.

14 Claims, 5 Drawing Figures

X-RAY FILM GRIP

This application relates to sheet support members, and more particularly to an x-ray film grip for holding an x-ray against a viewing surface.

In the typical x-ray viewer, a housing is provided with a translucent screen through which light is projected. The upper edge of the housing includes an x-ray film grip in which one edge of the x-ray to be viewed is inserted to be held by the grip against the viewing screen. These x-ray film grips provide a positive film engagement holding the film firmly in place wherever positioned by the physician.

While a variety of different types of x-ray film grips have been proposed in the past, one of the most popular is of the type in which a plurality of balls are mounted in a housing along the upper edge of the x-ray viewer. These balls project slightly from an elongated slot in a frame mounted on the x-ray film viewer and are engaged on the side thereof opposite the slot by one or more plates which are in turn spring biased outwardly to apply a spring pressure to the balls. While this type of film grip has been generally satisfactory in use, it is subject to a number of disadvantages, particularly in the fact that it is difficult and expensive to assemble. Moreover, because a plurality of balls are simultaneously biased outwardly by a single spring or a single spring biased plate, should one of the balls be depressed, while the others are not depressed, it is possible that the other balls will not be urged with the same force as they were previously, so that the film which they engage would loosen and fall from the grip.

Accordingly, it is an object of the present invention to provide an x-ray film grip which is durable in use and reliable in operation.

Another object of the present invention is to provide an x-ray film grip which is relatively inexpensive to manufacture and assemble.

A still further object of the present invention is to provide an x-ray film grip in which a plurality of substantially independent spring members are used to hold the x-ray film grip against the sheet support or viewing surface of the x-ray viewer.

A still further object of the present invention is to provide an x-ray film viewer which uses an essentially nondeformable spring element for holding the x-ray film against the viewing surface of the viewer.

In accordance with an aspect of the present invention the x-ray grip is adapted to be used with a conventional x-ray film viewer having an illuminating surface. The grip includes an elongated frame element which is mounted along the upper edge of the viewer, and has an elongated channel formed therein and a longitudinally extending slot which opens the channel towards the viewing surface. A spring support bar is slidably positioned in the channel and has a spring support surface extending generally parallel to the slot. The spring support surface of the bar includes an elongated bent flange extending therealong on the side of the bar facing the slot to define a spring mounting pocket therein. A spring element is mounted on the spring support surface of the support bar and is located substantially entirely within the channel. The spring element comprises a one-piece member having an elongated backing strip section and a plurality of substantially independent arcuately curved spring fingers integrally formed therewith. The spring fingers extend transversely of the bar and the slot, while the backing strip is secured to the support surface of the support bar. The backing strip has first and second longitudinally extending edge portions, with the first edge portion thereof being received in the pocket. The fingers of the spring each have one end integrally formed with the second edge portion of the backing strip and a second opposite free end located on the side of the slot opposite the first end. A central curved portion is provided on the spring fingers between their first and second ends, which curved portion is positioned adjacent to and normally projects slightly from the slot in the frame towards the viewing surface of the viewer. By this arrangement a sheet positioned between the frame and the sheet support surface will be engaged by the central curved portions of the spring fingers and held against the viewing surface.

The above, and other objects, features and advantages of this invention will be apparent in the following detailed description of an illustrative embodiment thereof, which is to be read in connection with the accompanying drawings, wherein.

Figure 1:
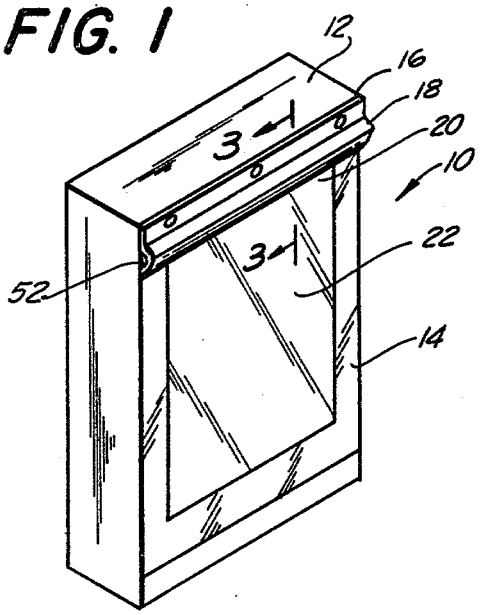
FIG. 1 is a perspective view of an x-ray film viewer which includes an x-ray film grip constructed in accordance with the present invention.

Referring now to the drawing in detail, and initially to FIG. 1 thereof, an x-ray film viewer 10 includes a housing 12 which contains a light source that is projected through a translucent screen or x-ray support surface 14. The upper edge 16 of housing 12 has an x-ray film grip 18, constructed in accordance with the present invention, mounted thereon. The film grip serves to releasably hold the upper edge 20 of an x-ray film sheet 22 against the translucent support surface 14 of the viewer. The physician viewing the x-ray simply slips the edge of the x-ray beneath the grip, which automatically holds the film in place. A slight pull on the x-ray releases the x-ray film sheet from the grip.

Figure 3:
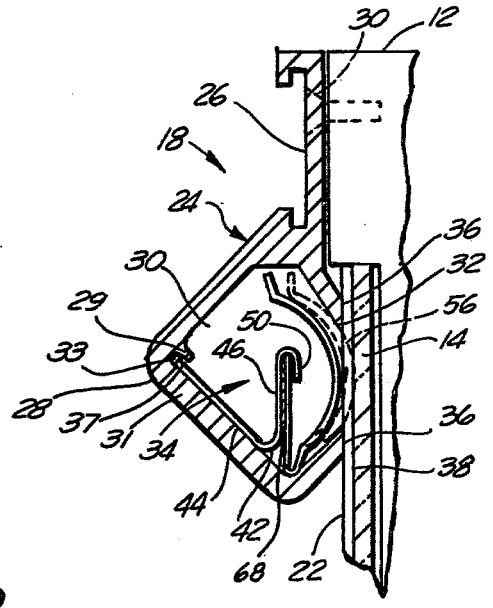
FIG. 3 is a sectional view taken along line 3—3 of FIG. 1.
Figure 2:
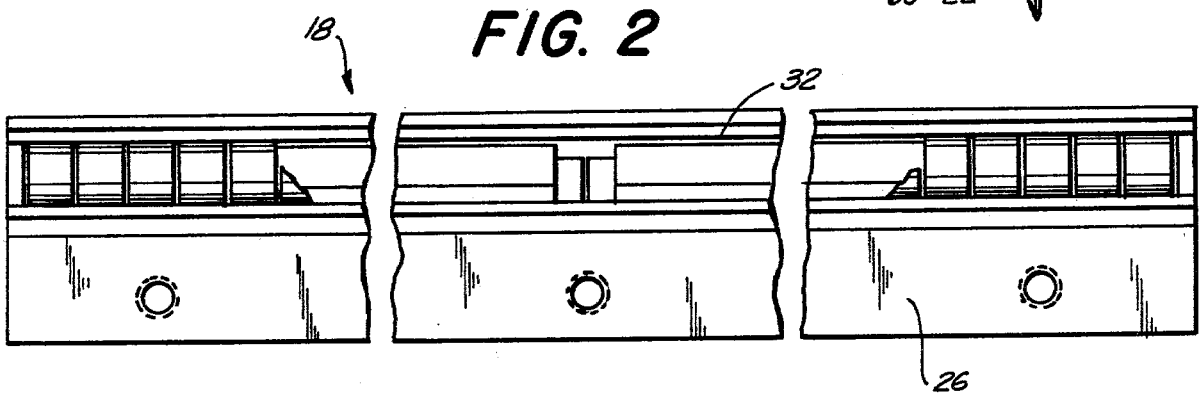
FIG. 2 is an inverted plan view of the side of the film grip shown in FIG. 1 which faces the film-viewing surface of the x-ray film viewer.

As seen in FIGS. 2 and 3, x-ray film grip 18 of the present invention includes a housing or frame 24 which consists of a mounting flange 26 and an integral channel element 28. The mounting flange 26 is secured to housing 12 of x-ray film viewer 10 with the aid of screws 30 or the like, so that the film grip is mounted securely in place at the upper edge of the housing.

The channel portion of the film grip is open at each end and has an elongated longitudinally extending passage or channel 30 formed therein. In cross section, as seen in FIG. 3, channel 30 has a polygonal configuration, with a longitudinal slot 32 formed therein on the side of the frame facing the translucent panel or sheet support surface. Channel section 28 houses a spring assembly 34 that serves to grip x-ray film 22 against viewing surface 14. In this regard it is noted that the front face 36 of housing channel 28, adjacent slot 32, is dimensioned to be spaced slightly from the front face 28 of viewing screen 14 so that x-ray film 22 can slip therebetween for engagement by spring assembly 34.

Figure 4:
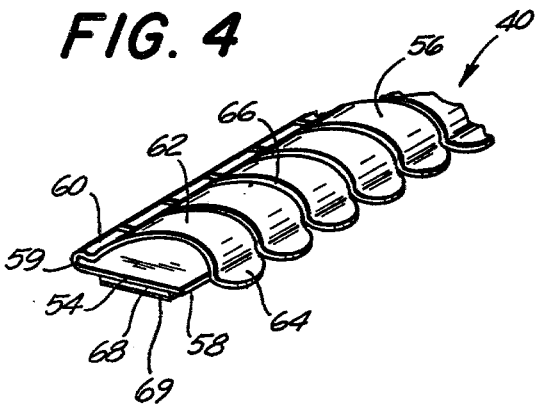
FIG. 4 is a partial perspective view of the spring element used in the film grip of the present invention.
Figure 5:
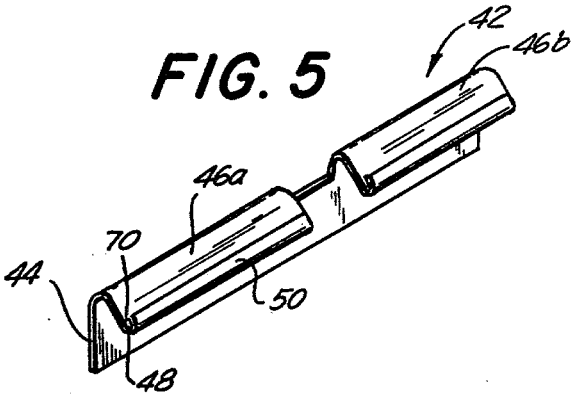
FIG. 5 is a perspective view of the spring support element used in the embodiment of the invention illustrated in FIGS. 1 and 2.

The spring assembly 34 consists of two elements, illustrated separately in FIGS. 4 and 5. These elements include a spring strip or element 40 and a spring support bar 42. The support bar consists of a relatively rigid (e.g. metal) element having a first flange 44 and a second angularly related flange 46 that defines a spring support surface. One edge 48 of spring support surface 46 includes a return flange 50 that is bent over spring support surface 46. Support bar 42 is slidably positioned within channel 30 and is inserted into the channel through one of the open ends 52 thereof so that, as seen in FIG. 3, its bent flange 50 faces the film support surface or viewing screen 14. However, before the support bar is inserted in the channel 28, it is secured to spring 40. In this regard, it is noted that housing 24 includes an internal rib 29 which extends parallel to the wall 34 of channel element 28 in slightly spaced relation to define a groove 33 therebetween. The groove receives the free end 37 of spring support flange 44 when the support bar is inserted in the housing. By this arrangement the rib 39 serves to lock bar 42 in place and prevents it from pivoting towards channel opening 32.

Spring element 40 is a one-piece element which includes a backing strip 54 and a plurality of fingers 56 integrally formed therewith. The backing strip is a solid element, having a first edge 58 and a second edge 59. Fingers 56 are integrally formed along the second edge 59 of strip 54 at first ends 60, and extend through a curved central portion thereof 62 to second free ends 64. The fingers are spaced slightly from one another by slots 66 so that each spring finger has essentially dependent resilience, for independent movement.

Spring element 40 is preferably formed of beryllium copper which has the property of shape memory, even when subjected to substantial stresses; that is, even though the spring fingers are stressed sufficiently to change their configuration, when the stress is relieved they will return to their original configuration. In addition, this material provides a relatively high spring force, and relatively strong spring fingers, even with an extremely thin stock.

A strip material which is suitable for use as the spring element 40 in the construction of the present invention is used and sold by the Instruments Specialties Co. of Little Falls, N.J. under the trademark "Sticky Fingers" as an RFI/EMI interference shield strip for use along the edges of electrical cabinets. In such use, these contact strips are used for electrical shielding, and not for a spring biasing or gripping purpose.

Preferably backing strip 54 is provided on its rear surface with an adhesive layer 68, protected by a strippable plastic sheet. When the device of the present invention is assembled, the plastic or paper sheet (not shown) is stripped from the adhesive layer and backing strip 54 is seated on spring support surface 46 of support bar 42, with its edge 58 received in pocket 70 defined by bent flange 50. This flange can then be crimped against edge 58 of the spring backing strip if desired.

In the illustrative embodiment, it is noted that support bar 42 is of substantial length, and is provided with two spring backing support surface sections **46*a* and 46*b*. In this embodiment, a separate spring element 40** is mounted on each of the support surfaces. Although, it is apparent that if the spring element is available in a sufficient length, only a single spring element need be used.

After spring element 40 is mounted on and secured to support bar 42, the spring assembly is inserted through one open end of channel 28 and slid until it is fully received within the channel. As mentioned, the assembly is inserted into the channel so that flange portion 50 of the spring support 46 faces slot 32. In this manner, spring fingers 56 face slot 32 and a portion of the curved central portion thereof extends through the slot.

After the spring assembly is inserted into the channel 30, the open ends 52 of the channels are closed by small metal plugs having a complementary configuration to the channel shape, which are simply frictionally held in place in the polygonal configuration of the channel.

The angle between flanges 44 and 46 of the support bar is selected to insure that the curved central portion of the spring fingers extend through slot 42 so that they engage the surface 38 of the viewing screen 14 with a slight pressure. This is indicated by the dotted line configuration of the spring fingers in FIG. 3. When it is desired to view an x-ray, the physician simply slips the x-ray sheet 22 between viewing screen 14 and the face 36 of channel 28, beneath spring fingers 56. The thickness of the film strip will depress the spring fingers which it engages and those fingers will apply a force against the film strip that will hold the strip against viewing screen 14. In this regard it is noted that since the spring is assembled so that its central portion projects through the slot 32, the width of the slot 32 has effect on the spring tension in the spring fingers. By narrowing the slot, the spring fingers can be prestressed somewhat to produce an even greater holding force against the film strip.

Each of the spring fingers 56 acts independently of the other spring fingers so that the x-ray film strip can be held in place only at a corner and by only a few of the spring fingers, without affecting the configuration of the other spring fingers. Thus the remaining spring fingers in the film grip are available for use in holding additional x-ray film strips on the viewer at the same time.

The x-ray film grip described herein is of extremely durable and inexpensive construction. The beryllium copper spring elements will have an extremely long useful life since they are essentially non-deformable. However, it is noted that other forms of spring elements could be used if desired.

Although an illustrative embodiment of the present invention has been described herein with reference to the accompanying drawings, it is to be understood that the invention is not limited to the precise embodiment, and that various changes and modifications may be effected therein by one skilled in the art without departing from the scope or spirit of this invention.

What is claimed is:

1. A sheet support member adapted to cooperate with a sheet support surface, comprising an elongated hollow frame element having a longitudinally extending slot formed therein facing said sheet support surface; an elongated spring element mounted in said frame having a plurality of separate spring fingers thereon, said spring fingers having bent central portions thereof positioned adjacent to and normally projecting from said slot towards said sheet support surface, said spring element having an elongated backing strip and said fingers being integrally formed therewith, said fingers being generally arcuately curved and extending transversely of said backing strip, said fingers each having one end integral with said backing strip and an opposite free end with said central bent portion therebetween; and means slidably positioned within the frame for mounting said spring element on said frame whereby a sheet positioned between said frame and said support surface will be engaged by said bent portions of the spring fingers and held against said support surface.

2. A sheet support member as defined in claim 1 wherein both said ends of said fingers are located within said frame.

3. A sheet support member as defined in claim 2 wherein said spring is formed of beryllium copper.

4. A sheet support member as defined in claim 2 wherein said mounting means comprises an elongated support bar having an elongated support surface; said backing strip being secured to said support surface.

5. A sheet support member as defined in claim 4 wherein said backing strip is adhered to said support surface of the bar.

6. A sheet support member adapted to cooperate with a sheet support surface, said support member comprising an elongated hollow frame element having a longitudinally extending slot therein facing said sheet support surface; an elongated spring element mounted in said frame, said spring element including an elongated backing strip having a pair of oppositely disposed edges and a plurality of separate arcuately curved spring fingers each extending transversely of said backing strip and having one end integrally secured to one edge of said backing strip and an opposite free end, each of said spring fingers having a bent central portion between said ends and positioned adjacent to and normally projecting from said slot towards said sheet support surface, both of said ends of said fingers being located within said frame; and means for mounting said spring in said frame whereby a sheet positioned between said frame and said support surface will be engaged by said bent portions of the spring fingers and held against said support surface, said mounting means including an elongated support bar having an elongated support surface secured to said backing strip, said support bar including a bent flange which is bent over the edge of said backing strip opposite the edge thereof to which said fingers are secured.

7. A sheet support member as defined in claim 5 wherein said frame is open at one end and said support bar is longitudinally slidable in said frame.

8. A sheet support member adapted to cooperate with a sheet support surface comprising, an elongated frame element having an elongated channel formed therein and a longitudinally extending slot therein opening said channel towards said sheet support surface; a spring support bar located in said channel and having a spring support surface extending generally parallel to said slot; and a spring mounted on said spring support surface of the support bar and located substantially entirely within said channel; said spring comprising a one piece spring element having an elongated backing strip section secured to the support surface of the support bar and a plurality of substantially independent arcuately curved spring fingers integrally formed therewith; said spring fingers extending transversely of said bar and slot; said fingers each having one end integral with said backing strip, a second opposite free end located on the side of said slot opposite said one end, and a central curved portion positioned adjacent to and normally projecting slightly from said slot towards said sheet support surface whereby a sheet positioned between said frame and said sheet support surface will be engaged by said central portions of the spring fingers and held against said sheet support surface.

9. A sheet support member as defined in claim 8 wherein said backing strip is adhered to said support surface of the bar.

10. A sheet support member as defined in claim 8 wherein said spring is formed of beryllium copper.

11. A sheet support member adapted to cooperate with a sheet support surface comprising an elongated frame element having an elongated channel formed therein and a longitudinally extending slot therein opening said channel towards said sheet support surface; a spring support bar slidably positioned in said channel and having a spring support surface extending generally parallel to said slot; said spring support surface including an elongated bent flange extending therealong on the side thereof facing said slot defining a spring mounting pocket; and a spring element mounted on said spring support surface of the support bar and located substantially entirely within said channel; said spring element comprising a one piece spring element having an elongated backing strip section and a plurality of substantially independent arcuately curved spring fingers integrally formed therewith; said spring fingers extending transversely of said bar and slot; said backing strip being secured to the support surface of the support bar and having first and second longitudinally extending edge portions with said first edge portion being received in said pocket; said fingers each having one end integral with said second edge portion of said backing strip, a second opposite free end, and a central curved portion positioned adjacent to and normally projecting slightly from said slot towards said sheet support surface whereby a sheet positioned between said frame and said sheet support surface will be engaged by said central portions of the spring fingers and held against said sheet support surface.

12. A sheet support member as defined in claim 11 wherein said frame is open at one end and said support bar is longitudinally slidable in said frame.

13. A sheet support member as defined in claim 11 wherein said spring is formed of beryllium copper.

14. A sheet support member as defined in claim 11 wherein said backing strip is adhered to said support surface of the bar.

* * * * *